US007413613B2

(12) United States Patent
Chen

(10) Patent No.: US 7,413,613 B2
(45) Date of Patent: Aug. 19, 2008

(54) METHOD FOR ACTIVATING ELECTRON SOURCE SURFACE OF FIELD EMISSION DISPLAY

(75) Inventor: Kuo-Rong Chen, Guanyin Township, Taoyuan County (TW)

(73) Assignee: Teco Nanotech Co., Ltd, Taoyuan County (TW)

( * ) Notice: Subject to any disclaimer, the term of this patent is extended or adjusted under 35 U.S.C. 154(b) by 0 days.

(21) Appl. No.: 11/090,170

(22) Filed: Mar. 28, 2005

(65) Prior Publication Data

US 2006/0216412 A1 Sep. 28, 2006

(51) Int. Cl.
*B08B 7/00* (2006.01)
*B08B 7/04* (2006.01)

(52) U.S. Cl. ..... 134/4; 134/19; 134/30

(58) Field of Classification Search ..... 134/4, 134/19, 42, 5, 6, 10, 26, 30
See application file for complete search history.

(56) References Cited

U.S. PATENT DOCUMENTS

| | | | | |
|---|---|---|---|---|
| 5,716,422 | A * | 2/1998 | Muffoletto et al. | 29/623.5 |
| 5,810,962 | A * | 9/1998 | Annenkov et al. | 156/344 |
| 5,863,234 | A * | 1/1999 | Makino | 445/60 |
| 5,891,297 | A * | 4/1999 | Stadtmueller | 156/344 |
| 5,891,298 | A * | 4/1999 | Kuroda et al. | 156/344 |
| 5,964,632 | A * | 10/1999 | Makino | 445/30 |
| 6,682,383 | B2 * | 1/2004 | Cho et al. | 445/50 |
| 6,972,513 | B2 * | 12/2005 | Shiratori et al. | 313/309 |
| 2003/0059968 | A1 * | 3/2003 | Cheng et al. | 438/20 |
| 2004/0238118 | A1 * | 12/2004 | Miyamoto | 156/344 |
| 2006/0006780 | A1 * | 1/2006 | Hsiao et al. | 313/310 |
| 2006/0160013 | A1 * | 7/2006 | Sasaki | 430/200 |

FOREIGN PATENT DOCUMENTS

| | | | |
|---|---|---|---|
| JP | 2004-87452 | * | 3/2004 |
| TW | 480537 | | 3/2002 |
| TW | 223308 | | 11/2004 |

OTHER PUBLICATIONS

Sumio Iijima, "Helical microtubules of graphitic carbon" Magazine of "Letters to Nature" Nov. 1991.

* cited by examiner

*Primary Examiner*—Alexander Markoff

(57) ABSTRACT

A method for activating surface of electron emission source of a field emission display. After a cathode structure is fabricated and sintered with high temperature, the surface of electron emission source is activated by employing a spray coating technology. The spray coating technology includes a spraying device. The spraying device employs compressed air to homogeneously spray the solution onto the surface of the cathode structure. The solution will then cover the gate electrode layer and permeate into the hole and sagged area on the surface of electron emission source to form a covering layer. The covering layer is then dried and peeled off using a roller peeling device. The roller peeling device includes two rollers, one of which includes a heating unit to heat and soften the covering layer when rolled on the covering layer of the cathode structure. The other roller can thus peel off the covering layer easily.

15 Claims, 1 Drawing Sheet

METHOD FOR ACTIVATING ELECTRON SOURCE SURFACE OF FIELD EMISSION DISPLAY

BACKGROUND OF THE INVENTION

The present invention relates generally to a method for activating the electron emission surface of a field emission display. More particularly, the present invention relates to a method for activating electron emission surface by employing a spray coating technology. By using compressed air, the solution is homogeneously spray coated on each pixel of the cathode structure. The solution forms a film after being dried, and the dried coating film is peeled off using a peeling apparatus, so as to activate the electron emission surface.

Conventional triode field emission display includes an anode structure and a cathode structure. There is a spacer disposed between the anode structure and the cathode structure, thereby providing a space and a support for the vacuum region between the anode structure and the cathode structure. The anode structure includes an anode substrate, an anode conducting layer, and a phosphorus layer, while the cathode structure includes a cathode substrate, a cathode conducting layer, an electron emission layer, a dielectric layer and a gate layer. The gate layer is provided a voltage difference to induce the emission of electrons from the electron emission layer. The conducting layer of the cathode structure provides a high voltage to accelerate the electron beam, such that the electron beam can have enough kinetic energy to impinge and excite the phosphorous layer on the anode structure, thereby emitting light. Accordingly, in order to maintain the movement of electrons in the field emission display, a vacuum apparatus is required to keep the vacuum degree of the display being below $10^{-5}$ torr. Therefore, the electrons can have appropriate mean free paths. Meanwhile, the pollution and toxication of the electron emission source and the phosphorous layer should be prevented from happening. Furthermore, in order for the electrons to accumulate enough energy to impinge the phosphorous powder, a space is required between the two substrates. Consequently, the electrons can be accelerated to impinge the phosphorous layer, thereby exciting the phosphorous layer and emitting light therefrom.

The electron emission layer is composed of carbon nanotubes. Since carbon nanotubes, discovered by Iijima in 1991 (Nature, 354, 56 (1991)), comprises very good electronic properties that can be used to build a variety of devices. The carbon nanotubes also has a very large aspect ratio, mostly larger than 500, and a very high rigidity of Young moduli larger than 1000 GPn. In addition, the tips or defects of the carbon nanotubes are of atomic scale. The properties described above are considered an ideal material for building electron field emitter, such as an electron emission source of a cathode structure of a field emission display. Since the carbon nanotubes comprise the physical properties described above, a variety of manufacturing process can be developed, e.g. screen printing, or thin film processing.

However, the art of manufacturing the cathode structure employs carbon nanotubes as a electron emission material, which is fabricated on the cathode conducting layer. The manufacturing process can employ chemical vapor deposition process, or any kind of process that can pattern the photosensitive carbon nanotube solution on any pixel of the cathode conducting layer. Moreover, the cathode structure can also be manufactured by coating the carbon nanotubes solution while incorporating with a mask, or depositing the carbon nanotubes on the cathode conducting layer by an electrophoresis method. Nonetheless, the cathode structure needs to be sintered in a 500° C. oven, so as to remove the residual solvent left on the cathode structure and to enhance the adhesion of the carbon nanotubes affixed on the cathode conducting layer.

However, the manufacture process of the cathode structure is not completed yet. In general, a so-called surface activation process is needed after the high temperature sintering process. Since the high temperature sintering process still can not remove other non-nanotube carbon bulks, other non-crystalline carbon nanotube, other bulky carbon balls, or other organic materials formed during the high temperature sintering process on the electron emission surface. The impurities described above can affect the electron production rate of the carbon nanotube electron emitter. Therefore, the surface activation process described above is deemed necessary, so as to remove or transform the above impurities, thereby enhancing the electron production rate of the electron emitter.

One conventional method is disclosed in the Taiwanese publication no. 480537, entitled "a method for enhancing the field emission efficiency of carbon nanotube emission source". The film peeling process after the adhesion thereof uses a type to adhere on the surface of the electron emission source. The tape is then peeled off to remove the residue materials described above, thereby achieving the activation purpose. In addition, the recently developed thermal processing of laser or plasma can produce high temperature instantaneously to re-crystallize or remove the non-crystalline carbon. Moreover, using the sandblast processing can also destroy and remove the defective materials.

However, the method as described above still involves disadvantages. For example, since a tape can reach the electron emission source, although the film peeling using a tape is less costly, it is inapplicable to the electron emission source already manufactured in the triode of the cathode structure. In addition, the laser or plasma processing is inapplicable to panels of larger sizes, while the manufacturing cost thereof is very high. Furthermore, the sandblast processing can damage the carbon tube structure, and in applicable to the cathode structure of high pixel resolutions.

Another conventional method is disclosed in the Taiwanese letters patent no. I223308, entitled "a process for enhancing the field emission current of carbon nanotube electron source". This method uses a thermal glue or a soluble paint to perfuse onto each pixel of the triode structure on the surface of the electron emission source. The thermal glue is peeled off after curing, so as to activate the surface of electron emission source. The advantage of this method is in that the manufacturing process is simple and less costly. However, this method is still very restrictive. One of the restrictions is that the viscosity of the thermally soluble paint is still higher than 1000 cps even during the thermal process. Since the field emission display is of a product of high resolution, the length and width of each pixel is very small. For this reason, air bubbles are easily formed between the thermal glue and the pixel hole even if the high viscosity glue is heated up to a high temperature. The air bubbles will prevent the glue from securely sealing the electron emission source of carbon nanotubes. Accordingly, the surface is unlikely to be activated in full, which will render inhomogeneous activation areas on the surface of the electron emission source, thereby victimizing the display quality.

In addition, the peeling mechanism described above has not been disclosed completely. The peeling process described above requires a homogeneous physical force applied vertical to the electron emission source. If an arbitrary peeling process is performed, a homogeneous activation will not be obtained.

In particular, a peeling mechanism applicable to mass production for the future large size displays is especially demanding.

BRIEF SUMMARY OF THE INVENTION

The present invention is to solve the restrictions described above that the surface of the cathode electron emission source of a triode structure could not be activated fully using the conventional method. The present invention is to provide a method that sprays a solution on the surface of electron emission source to form a covering film, and completely activates the surface of electron emission source by peeling off the covering film. The spray coating method can completely perfuse the solution into each pixel of the triode cathode structure, thereby overcoming the problems in conventional art. After the perfused solution is dried and a film is formed, the film is then peeled off to remove the residual carbon material or organic oxides remained on the surface of electron emission source. The peeling mechanism incorporated with a peeling device can homogeneously activate the surface of electron emission source.

In order to achieve the above and other objectives, the method for activating surface of electron emission source of a field emission display of the present invention includes the following steps. First, a cathode structure is fabricated and sintered with high temperature. The surface of electron emission source is activated by employing a spray coating technology. The spray coating technology includes a spraying device. The spraying device employs compressed air to homogeneously spray the solution onto the surface of the cathode structure. The solution will then cover the gate electrode layer and permeate into the hole and sagged area on the surface of electron emission source to form a covering layer. The covering layer is then dried and peeled off using a roller peeling device. The roller peeling device includes two rollers, one of which includes a heating unit to heat and soften the covering layer when rolled on the covering layer of the cathode structure. The other roller can thus peel off the covering layer easily.

DETAILED DESCRIPTION OF THE INVENTION

In order to better understanding the features and technical contents of the present invention, the present invention is hereinafter described in detail by incorporating with the accompanying drawings. However, the accompanying drawings are only for the convenience of illustration and description, no limitation is intended thereto.

Figure 1:
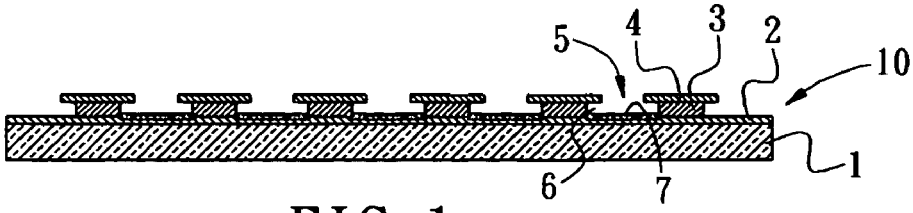
FIG. 1 illustrates the cathode structure of the present invention.

Referring to FIG. 1, the cathode structure of the present invention is illustrated. As shown, the method for activating the electron emission surface of a field emission display includes the steps of spray coating a covering film on the surface of electron emission source of a cathode structure, and then peeling off the covering film to complete the activation of the surface of electron emission source. The so-called spray coating method can completely perfuse the covering solution into each pixel of the triode cathode structure, so as to overcome the inhomogeneity problem in the conventional thermal molding technology. Later, the perfused solution is dried to form the covering film, and then performing the peeling process, so as to remove the residual carbon material or organic oxide on the surface of electron emission source. Performing this method requires little cost and very and complexity, which can overcome the structural limitation of the activation process. The spray coating method can precisely activate a certain region of surface. By further incorporating with a roller peeling mechanism, one can further enhance the peeling homogeneity.

First, a triode cathode structure 10 is fabricated before spray coating any solution thereon. The cathode structure 10 provides a substrate 1. In one particular embodiment, the substrate 1 is made of glass. An electrode layer 2 is formed on the substrate 1 using silver glue. A dielectric layer 3 is formed on the electrode layer 2. A gate electrode layer 4 is formed on the dielectric layer 3. A hole 5 is formed on the gate electrode layer 4 employ a lithography or etching method. The sagged area 6 of the electrode layer 2 is thus exposed. Thereafter, an electron emission source 7, which is made of carbon nanotubes, is formed on the electrode layer 2.

Figure 2:
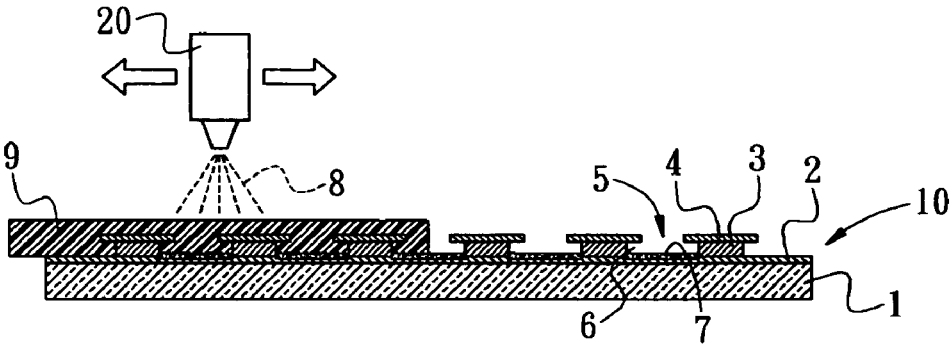
FIG. 2 illustrates the spray coating process for manufacturing the cathode structure of the present invention.
Figure 3:
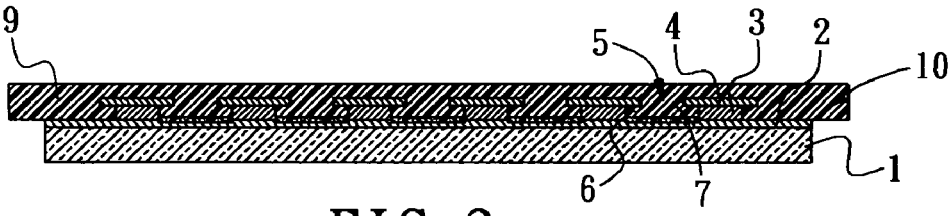
FIG. 3 illustrates the completion of the spray coating process for manufacturing the cathode structure of the present invention.

Referring to FIG. 2 and FIG. 3, the spray coating process and the completion thereof are illustrated, respectively. As shown, after the cathode structure 10 is fabricated and sintered with high temperature, the surface of the electron emission source 7 is then activated.

When activating the surface of electron emission source 7, the spray coating technology includes a spray coating device 20. The spray coating device 20 is filled with solution 8. The spray coating device 20 uses compressed air to homogeneously spray the solution 8 onto the surface of the cathode structure. The solution will cover the gate electrode layer 4 and permeate into the hole 5 and the sagged area 6 to coat on the surface of electron emission source 7 and to form a covering layer 9 (as shown in FIG. 3). The coated film is then dried.

In the first embodiment of the present invention, the spray coating technology described above can be realized by using a commercially available sprayable peelable protection film, which is used in conventional art as a protection film for metal surfaces. The so-called sprayable peelable film is made of a polymer material, which is filled in the compressed air chamber. Conventionally, such polymer materials are used to form an anti-oxidation film on metal surfaces. The polymer material solution is driven by the compressed air to form tiny droplets and is sprayed onto a surface. Since the solution is volatile, a protection film will be formed after the solution is dried. In this manner, the commercially available spray coating solution is sprayed on the cathode structure 10. One can repeat this spraying process to fill the solution into each pixel. After the sprayed solution is dried, a film is thus formed.

In the second embodiment of the present invention, the solution can be a 5% to 10% hydraulic solution of the PVA or PVP. The room temperature viscosity of the solution is controlled to be below 1000 cps. After heating up by 50 to 80° C., the viscosity can be controlled to be below 500 cps. By using a spraying gun, the paint is nebulized by the compressed air and sprayed on the surface of electron emission source 7 of the cathode structure 10. In order to incorporate the ratio of solution and the suspended particle, the amount of air inlet for the spraying gun should be at least larger than 200 l/min. Since the sprayed solution is a hydraulic solution, the cathode structure 10 to be sprayed needs to be preheated, so as to maintain the temperature of the cathode structure 10 being 50 to 80° C. Therefore, the sprayed solution 8 can be dried immediately. Since the spraying process can be repeated, sufficient filling of the nebulized paint onto the surface of electron emission source 7 is assured.

Figure 4:
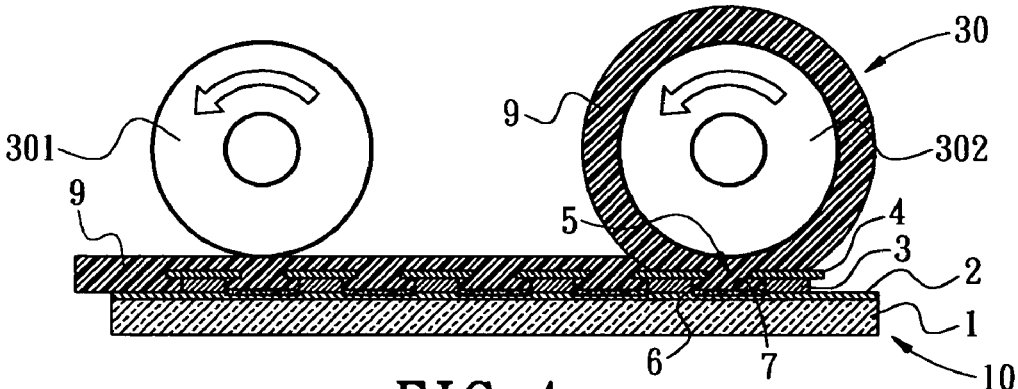
FIG. 4 illustrates the process of peeling off the covering layer on the cathode structure of the present invention.

After the solution is dried and a film is formed, a roller peeling device 30 is used to peel off the film, as shown in FIG. 4. The roller peeling device 30 includes to rollers 301, 302. The roller 301 includes a heating unit. The roller 301 first heats up and softens the covering layer 9 when the roller 301 is rolled on the covering layer 9 of the cathode structure 10. The roller 302 can then easily peel off the covering layer 9. The non-nanotube carbon bulks, the non-crystalline carbon nanotubes, the carbon bulky balls, or the organic materials remained on the surface of the electron emission source during the high temperature sintering process of the cathode structure 10 are thus peeled off together with the covering layer 9. For this reason, the field emission display so manufactured has better display quality.

Further, the covering layer formed on the cathode structure 10 has a thickness of 0.1 to 0.5 mm to incorporate with the roller peeling device Even further, the cathode substrate is baked in an oven for 10 to 20 minutes under a temperature of 60 to 80° C., thereby solidifying the covering layer. After the coverying layer is dried and a film is formed, the roller peeling device 30 is used to peel off the film. The surface of electron emission source 7 is thus homogeneously activated.

Since, any person having ordinary skill in the art may readily find various equivalent alterations or modifications in light of the features as disclosed above, it is appreciated that the scope of the present invention is defined in the following claims. Therefore, all such equivalent alterations or modifications without departing from the subject matter as set forth in the following claims is considered within the spirit and scope of the present invention.

What is claimed is:

1. A method for activating surface of electron emission source of a field emission display, comprising the steps of:

providing a sintered cathode structure;

spraying a solution of either PVA or PVP on the cathode structure to form a covering layer;

drying the covering layer on the cathode structure to form a film;

heating and softening the film formed on the surface of the cathode structure by a roller peeling device having two rollers as a peeling device, wherein a first roller performs the heating function; and subsequently peeling and removing the soften carbon materials or an organic oxides remained on the surface of electron emission source of the cathode structure by a second roller of the roller peeling device.

2. The method as recited in claim 1, wherein the cathode structure is a triode field emission display.

3. The method as recited in claim 2, wherein the cathode structure comprises a substrate, an electrode layer formed on the substrate, a dielectric layer formed on the electrode layer, a gate electrode layer formed on the dielectric layer, a hole formed on the gate electrode layer, a sagged area exposing the electrode layer, and an electron emission source made of carbon nanotubes formed on the electrode layer.

4. The method as recited in claim 1, wherein spraying a solution further using a spray coating device which is a compressed air chamber.

5. The method as recited in claim 1, wherein spraying a solution further using a spray coating device which is a spraying gun.

6. The method as recited in claim 5, wherein the spraying gun nebulizes the solution by using compressed air and sprays the solution onto the surface of electron emission source of the cathode structure.

7. The method as recited in claim 5, wherein the spraying gun has an air inlet capacity of at least larger than 200 l/mm.

8. The method as recited in claim 1, wherein the solution is a 5% to 10% hydraulic solution.

9. The method as recited in claim 8, wherein a viscosity of the solution is below 1000 cps.

10. The method as recited in claim 8, wherein the viscosity of the solution is below 500 cps when heated to 50 to 80° C.

11. The method as recited in claim 1, wherein the spraying device is heated to 50 to 80 ° C. during the step of spraying a solution.

12. The method as recited in claim 1, wherein the cathode structure is heated to 50 to 80° C., during the step of spraying a solution.

13. A method for activating surface of electron emission source of a field emission display, comprising the steps of:

providing a sintered cathode structure;

spraying a solution on the cathode structure to form a covering layer;

drying the covering layer on the cathode structure to form a film; and heating and softening the film formed on the surface of the cathode structure by a roller peeling device having two rollers as a peeling device, wherein a first roller performs the heating function; and subsequently peeling and removing the soften carbon materials or an organic oxides remained on the surface of electron emission source of the cathode structure by a second roller of the roller peeling device.

14. The method as recited in claim 1, wherein the covering layer formed on the cathode structure has a thickness of 0.1 to 0.5 mm.

15. The method as recited in claim 1, wherein the cathode structure being coated with covering layer is baked for 10 to 20 minutes under a temperature of 60 to 80° C., thereby solidifying the covering layer.

* * * * *